US005116037A

United States Patent [19]

Gerlier et al.

[11] Patent Number: 5,116,037

[45] Date of Patent: May 26, 1992

[54] APPARATUS FOR RECEIVING AND ISSUING SHEETS

[75] Inventors: André Gerlier, Sciez, France; Yves Berthet, Onex, Switzerland

[73] Assignee: Landis & Gyr Betriebs AG, Zug, Switzerland

[21] Appl. No.: 732,079

[22] Filed: Jul. 18, 1991

[30] Foreign Application Priority Data

Apr. 8, 1991 [CH] Switzerland ..... 01031/91

[51] Int. Cl.[5] ..... B65H 3/12; B65H 29/16

[52] U.S. Cl. ..... 271/3.1; 271/5; 271/42; 271/84; 271/90; 271/267

[58] Field of Search ..... 271/3.1, 90, 107, 42, 271/267, 84, 5

[56] References Cited

U.S. PATENT DOCUMENTS 4,580,774 4/1986 Yamaguchi ..... 271/84 X
4,616,816 10/1986 Stauber ..... 271/267 X
4,804,175 2/1989 Granjean .
4,830,351 5/1989 Stanislaw .
4,830,742 5/1989 Takesako .

FOREIGN PATENT DOCUMENTS 0072237 2/1983 European Pat. Off. .
9005298 10/1990 Fed. Rep. of Germany .
2593485 7/1987 France .
1510934 5/1978 United Kingdom .
1542355 3/1979 United Kingdom .
2130414 5/1984 United Kingdom .
2161145 1/1986 United Kingdom .
2168689 6/1986 United Kingdom .
2198122 6/1988 United Kingdom .

OTHER PUBLICATIONS

"Bill Arrangement Mechanism for Bill-Handling Machine," K. Satoh, IBM Tech. Disclosure Bulletin, vol. 26, No. 9, Feb. 1984, pp. 4580–4581.

*Primary Examiner*—Richard A. Schacher
*Attorney, Agent, or Firm*—Marmorek, Guttman & Rubenstein

[57] ABSTRACT

An apparatus for the fault-free receiving and issue of sheets has guide rollers which are arranged on a carriage and which engage into belts to alter the geometry of the belts when the carriage is displaced on a rail over a stack by means of a drive. In the receiving or issue operation the sheet to be stacked or a top sheet to be issued rolls, without sliding, around one of the outer guide rollers, on the stack. Disposed between the outer guide rollers on a roller shaft are rotatable suction rollers whose suction cap sucks up the top sheet by means of reduced pressure at the beginnning of an issue cycle. A control arrangement is adapted to trigger off apparatus receiving and issue cycles and establishes predetermined positions of the carriage on the rail.

12 Claims, 2 Drawing Sheets

APPARATUS FOR RECEIVING AND ISSUING SHEETS

BACKGROUND OF THE INVENTION

1. Field of the Invention

The invention relates to an apparatus for receiving and issuing sheets. Such apparatuses are suitable for example for automatic service machines in which bank notes are received or issued.

2. Description of the Prior Art

An automatic machine for receiving or issuing larger amounts of money, which is suitable for the cash point business of banks, is known for example from United Kingdom patent application GB-A-2161145 and German patent application DE-A-3 519 635. Bank notes which are sorted on the basis of their nominal values are stacked in intermediate storage arrangements until they have to be issued to a customer. The stacks of bank notes are fed on their top side by means of the bank notes which are paid in by the customers, while in a note issuing operation the lowermost bank note of the predetermined stack of notes is pulled out by means of a friction wheel.

United Kingdom patent application GB 1542355 and German patent application DE-A-2 751 422 also disclose a singling or separating apparatus which involves the use of reduced pressure for lifting individual bank notes from the stack of notes. The one end of the uppermost note of the stack of notes is held fast under a retainer plate. The other end of the uppermost bank note is disposed directly beneath a suction roller with an axis arranged fixedly above the stack, which at a predetermined moment in time lifts the bank note by means of a reduced pressure; in that situation, by virtue of rotary movement of the suction roller through 180°, an individual bank note is pulled out beneath the retainer plate and passed to a transportation system.

In such apparatuses the mechanical loading applied to the bank notes is high, and that requires high values in respect of their mechanical strength. That value falls below an acceptable limit value in relation to heavily used bank notes so that such notes can give rise to mechanical faults and disturbances in the apparatus.

Swiss patent application No. 02 566/90-1, filed on Aug. 6, 1990, and its corresponding U.S. patent application entitled "Apparatus for Stacking Sheets" by André Gerlier, which is being filed on even date herewith (both of which are incorporated herein as if printed in full below), describe an apparatus for stacking sheets, in which a carriage which is displaceable over at least one stack changes the geometry of transportation belts by means of guide rollers in order to deposit the sheet on the stack without the transportation belts or the sheet to be deposited sliding on the previous top sheet of the stack. In that way it is possible for sheets falling in a wide range of values in terms of mechanical strength to be processed in a fault-free manner. Depending on time synchronisation of the supply of sheets to the apparatus and the movement of the carriage, the sheet can be deposited in a predetermined manner on one of a plurality of juxtaposed stacks over which the carriage passes.

OBJECT AND SUMMARY OF THE INVENTION

An object of the invention is that of providing a simple and inexpensive apparatus for receiving and issuing sheets, in which both the operation of depositing the sheets and also the operation of lifting off the sheets occur on the top side of a stack and in which the mechanical loading on the sheets is small.

In accordance with the present invention, there is provided an apparatus for receiving and issuing sheets, comprising a rail and a carriage mounted for movement along a path on said rail. First and second outer guide rollers are mounted on said carriage and a central guide roller is mounted on said carriage between said first and second outer guide rollers. A first belt extends between said first and central guide rollers, part-way around and below said central guide roller, and between said second and central guide rollers. Also, a second belt is provided having first and second portions. Said first portion of said second belt extends part-way around said first guide roller and defines with the first belt a first transportation path for sheets, and said second portion of said second belt extends part-way around said second guide roller and defines with the first belt a second transportation path for sheets. A support means supports a stack of sheets below said path of movement of said carriage and a drive means is provided for causing the carriage to move along said path of movement. In particular, in accordance with the invention, there are provided first and second suction devices and control valves associated with said first and second outer guide rollers, respectively, each control valve being operable to cause the respective suction device to suck a top sheet of said stack towards the respective portion of said second belt; and control means operably connected to said drive means, control valves and detecting means and operable in an issuing cycle to recognize a position of said carriage along said rail which is suitable for one of said suction devices to suck the top sheet of the stack, to operate the respective control valve to cause that suction device to suck said top sheet, and to cause said drive means to move said carriage such that said top sheet is rolled from said stack in a slip-free manner around the respective outer guide roller and is carried along the respective transportation path.

Other objects, features and advantages of the present invention will become apparent upon consideration of the following detailed description of a preferred embodiment thereof, especially when considered with the accompanying drawings in which like reference numerals are employed to designate the same or similar components in the different figures.

DETAILED DESCRIPTION OF THE PREFERRED EMBODIMENT

Figure 1:
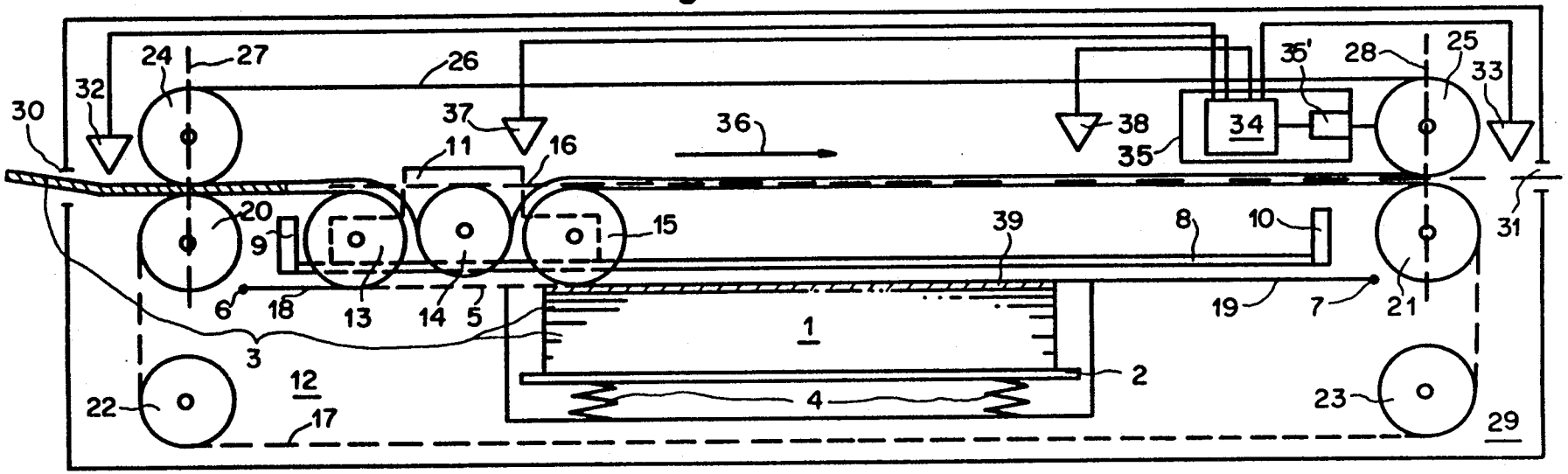
FIG. 1 shows an apparatus for receiving and issuing sheets.

In FIG. 1 reference numeral 1 identifies a stack of sheets, reference numeral 2 identifies a support plate and reference numeral 3 identifies sheets which are laid on the plate 2 and form the stack 1. Springs 4 act by way of the plate 2 to press the stack 1 upwardly to a top-of-stack plane 5 defined by fixed points 6 and 7 lying outside the stack 1.

Arranged above the top-of-stack plane 5 and parallel thereto is a rail 8 for a carriage 11 which is displaceable on the rail 8 between limit positions 9, 10. The limit positions 9, 10 are disposed outside the region of the stack 1. The carriage 11 carries three guide rollers 13, 14, 15 in mutually juxtaposed relationship. The top-of-stack plane 5 is tangential to lower portions of the two outer guide rollers 13, 15 and a transportation plane 16 which is parallel to the top-of-stack plane 5 is tangential to upper portions of the rollers 13, 15. Also, both two planes 5, 16 and the axes of the rollers 13, 14, 15 are perpendicular to the plane 12 of the paper of FIG. 1.

A belt 17 of predetermined length is fixed with its two ends 18, 19 by belt anchorages at the fixed points 6, 7. Each end 18, 19 is taut in the top-of-stack plane 5 between the respective fixed point 6, 7 and the respective adjacent outer guide roller 13, 15 and passes in a semicircle around the respective guide rollers 13, 15 into the transportation plane 16 and extends in that plane beyond the fixed point 6, 7, respectively, to a respective direction-changing roller 20, 21. The belt 17 connects the two ends 18, 19 by way of further direction-changing rollers 22, 23. In the drawing, a part of the belt 17 which is between the direction-changing rollers 20, 21 is shown in broken line as that part of the belt 17 and the further direction-changing rollers 22, 23 may also be disposed outside the plane 12 of the paper.

Two end rollers 24, 25 and the central guide roller 14 tension an endless belt 26 which bears against the belt 17 in the transportation plane 16 in the regions between the end rollers 24, 25 and the respective outer guide rollers 13, 15. Between the two outer guide rollers 13, 15, the endless belt 26 is depressed by means of the central guide roller 14, out of the transportation plane 16 towards the top-of-stack plane 5, with a predetermined spacing being maintained relative to the plane 5.

The axes of the rollers 20, 21, 22, 23, 24, 25 are fixed. The axes of each direction-changing roller 20, 21 and its respective end roller 24, 25 define a respective entry plane 27, 28 which is perpendicular to the top-of-stack plane 5 and transportation plane 16. When the carriage 11 is moved between the limit position 9, 10, the belts 17, 26 can engage a sheet 3 in the entry plane 27 or 28 and convey it, clamped between the belts 17, 26, towards the carriage 11 in the transportation plane 16.

The carriage 11, the belts 17, 26 and the associated rollers 13 to 15 and 20 to 25 form a transportation system 29 having gates 30, 31 on oppositely disposed sides outside the entry planes 27 and 28 and in the transportation plane 16. Arranged between the first gate 30 and the first entry plane 27 is a first sensor 32, for example a light barrier arrangement, for detecting the presence of the sheet 3 in the first gate 30. A second sensor 33 is disposed between the second gate 31 and the second entry plane 28. Each sensor 32 and 33 is connected by means of a line to a control arrangement 34 which controls a drive 35 of the transportation system 29. The drive 35 advantageously includes a stepping motor 35' as the control arrangement can calculate the respective position of the carriage 11 on the rail 8 by counting off the steps covered by the drive 35.

The modes of operation of the transportation system 29, which take place under the control of the control arrangement 34, include a receiving and issuing cycle and idle motions in both directions between the limit positions 9 and 10. The term idle motion is used to identify movement of the carriage 11 when no sheet 3 is conveyed out of or into the transportation plane 16. The control arrangement 34 begins to perform the predetermined cycle in response to an external command while the control arrangement 34 triggers off idle motions after a self-ascertained requirement at the beginning of the cycle.

Disposed along the rail 8 are for example two sensing devices 37 and 38, for example light barrier arrangements, which are connected to the control arrangement 34 by way of lines and the signals from which are triggered off by the carriage 11 as it moves therepast. The position of the sensing devices 37, 38 along the rail 8 is predetermined by the stack 1. The first sensing device 37 sends the sensing signal to the control arrangement 34 when the carriage 11, moving in a direction 36, rolls with the second outer guide roller 15 over the front or leading edge, which is towards the first limit position 9, of a top or cover sheet 39 on the stack 1. The control arrangement 34 receives from the second sensing device 38 a signal indicating the moment in time at which, in a motion in the opposite direction to the direction 36, the carriage 11 rolls with the first outer guide roller 13 over the rear or trailing edge of the top sheet 39, which is towards the second limit position 10.

The control arrangement 34 controls the drive of the transportation system 29 in a predetermined fashion in dependence on the signals from the sensors 32, 33 and the sensing devices 37, 38. For example the first sensor 32 detects the presence of the leading edge of the sheet 3 which is being transported towards the carriage 11, and passes a sensing signal to the control arrangement 34 which switches on the drive 35 in a predetermined manner. In that case the drive 35 sets the endless belt 26 in movement in the counter-clockwise direction. Frictional forces in the transportation plane 16 transmit the movement of the endless belt 26 to the belt 17, in which case the carriage 11 which is waiting in the first limit position 9 is accelerated in the direction 36 towards the second limit position 10. The belts 17 and 26 convey the sheet 3 which is engaged in the entry plane 27 in the direction 36 at double the speed of the carriage 11. When it reaches the first guide roller 13, the sheet 3, with its leading edge clinging closely against the belt 17, is deflected through 180° out of the transportation plane 16 into the stack plane 5.

For example the sheets 3 may be of different predetermined sizes, such as bank notes from a predetermined set of nominal values. A length of sheet as measured in the direction 36, which can be deposited on the stack 1 by the apparatus, depends only on the length of the rail 8 which is available for the sheet deposit operation. A width of sheet as measured transversely to the direction 36 must be at least so great that the sheet 3 is guided by means of the belts 17 and 26 in at least two belt planes 12. The sheets 3 may also be transported by the belts 17 and 26 in a predetermined fashion with their largest dimension both transversely and also longitudinally relative to the direction 36.

After triggering of the receiving cycle by the external receiving command, the carriage 11 moves into the respective limit position 9 and 10 and waits there until the sensor signal from the sensor 32 or 33 respectively is received at the control arrangement 34. The carriage 11 now moves to the other limit position 10 or 9 respectively. The first limit position 9 on the rail 8 is so predetermined that, as shown in the drawing in FIG. 2, the front or leading edge of the sheet 3, after being deflected into the stack plane 5, is deposited flush on an edge of the stack 1 which is nearest the first entry plane 27 (FIG. 1). While the carriage 11 is continuing to move in the direction 36, the sheet 3 is rolled down on to the stack 1 as a new top sheet 39, around the first guide roller 13, without slipping, with the position of the front and rear sides of the sheet 3 being interchanged in the stacking operation. The receiving cycle is terminated with the arrival of the carriage at the other limit position 10 or 9 respectively (FIG. 1).

A deflector 40 which is arranged on the carriage 11 between the outer guide roller 13 or 15 and the central guide roller 14 guides the sheet 3 in contact with the belt 17 out of the transportation plane 16 around the outer guide roller 13 into the plane 5 and reliably guides even relatively stiff or very soft sheets 3 on to the stack 1 where they are deposited without folding in the predetermined position when the carriage 11 is in the second limit position 10.

When the sheet 3 is passed through the gate 31 (FIG. 31) into the transportation plane 16 and the sensor signal of the sensor 33 (FIG. 1) is produced, the carriage 11 moves away from the second limit position 10 towards the limit position 9. The sheet 3 is rolled down as a new top sheet 39 on to the stack 1, around the second outer guide roll 15, without slipping, with the leading edge of the new top sheet 39 being deposited flush on the edge of the stack 1 which is closer to the gate 31.

Figure 3:
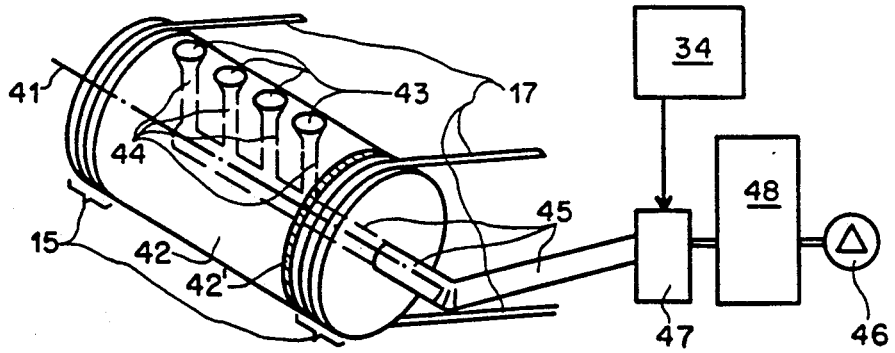
FIG. 3 shows a suction roller between guide rollers.

The configuration of the outer guide rollers 13 and 15, which is advantageous in regard to reliable issue of the top sheet 39, is shown in FIG. 3 in relation to the example of the guide roller 15. A common roller axis or shaft 41 carries at least one guide roller 15 and a suction roller 42 of at most the same diameter as the guide roller 15. For example, two guide rollers 15 are spaced by a suction roller 42, which are mounted rotatably on the roller shaft 41. Arranged between at least one of the outer guide rollers 15 and the suction roller 42 is a coupling 42' which in a predetermined fashion transmits the rotary movement of the outer guide roller 15 to the suction roller 42.

On a generatrix the suction roller 42 has a number of suction cups 43 comprising a soft resilient material. Each suction cup 43 is carried in a radial bore 44 in the suction roller 42 and projects with the edge of its suction surface only by a few tenths of a millimeter beyond the surface of the suction roller 42. The air in the suction cup 43 can be sucked away through the bore 44 or can be supplied by way of the bore 44 by means of a venting action. When a plurality of suction rollers 42 are arranged in a row on the same roller shaft 41, the suction cups 43 are arranged on the generatrix which is common to the suction rollers 42. The suction rollers 42 on the same shaft 41 are coupled together so as to preserve alignment of the suction cups 43.

All suction cups 43 on the generatrix are connected by way of a suction line 45 to a pump 46. The suction line 45 has a control valve 47 which in one position communicates the pump to the suction line 45 for the emptying operation while in the other position it vents the suction line 45. A signal line connects the control arrangement 34 to the control valve 47 which is switched over in response to a command from the control arrangement 34 between its two positions, namely emptying and venting. The first sensing device 37 (FIG. 1) triggers off switching over of the control valve 47 for the second guide roller 15, while the second sensing device 38 (FIG. 1) triggers off switching over of the control valve 47 for the first outer guide roller 13 (FIG. 1).

Therefore, associated with each of the two outer guide rollers 13 and 15 is at least one suction cup 43 which sucks the top sheet 39 thereto by means of a reduced pressure at the beginning of the issue cycle. In a simple construction, the suction cup 43 may be used on its own without the suction roller 42. It is directed radially outwardly and is so connected to the guide roller 13 or 15 respectively that it projects somewhat beyond the notionally extended cylindrical surface of the guide roller 13 or 15 respectively. The suction cup 43 may also follow the guide roller 13 or 15 respectively only over the rotary angle of about 135° of the guide roller 13 or 15 respectively, as is required to pick up the top sheet 39.

A reservoir vessel 48 interposed between the pump 46 and the control valve 47 increases the speed of the emptying operation and serves as a branch means for the control valve 45 of the suction roller 42 for the first outer guide roller 13.

The suction roller 42 for example continuously rotates together with the guide roller 15 or 13 respectively in fixed engagement with the belt 17 so that the radial orientation of the suction cups 43 is a function of the distance covered by the carriage 11 (FIG. 1) on the rail 8 (FIG. 1).

The external issue command initiates the issue cycle. For example, in FIG. 4*a*, the carriage 11 moves in the direction 36 towards the stack 1 after the carriage 11 has possibly returned to the first limit position 9 (FIG. 1) in an idle motion.

Figure 4A:
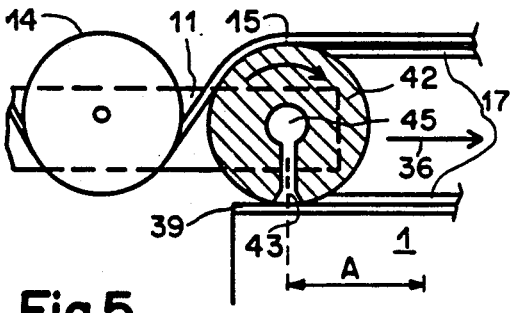
FIG. 4*a* shows the carriage before the operation of lifting off a top sheet.

FIG. 4*a* shows the guide roller 15 immediately after rolling over the front or leading edge of the top sheet 39. As soon as the carriage 11 passes with the second guide roller 15 over the front or leading edge of the sheet 39 in the direction 36, the first sensing device 37 (FIG. 1) triggers off the step of sucking away the air in the suction line 45 and in the suction cups 43 when the carriage 11 begins to cover a suction distance A in the direction 36.

The suction roller 42 is aligned with the stack 1 in such a way that, after having rolled over the leading edge of the sheet 39, the suction cups 43 always lie with the edge of their suction surface flat on the front end of the sheet 39. In the suction removal operation, there is a reduced pressure in the suction cups 43 whereby the front end of the sheet 39 is lifted off the stack 1 by the external air pressure, and pressed snugly against the suction roller 42.

Figure 4B:
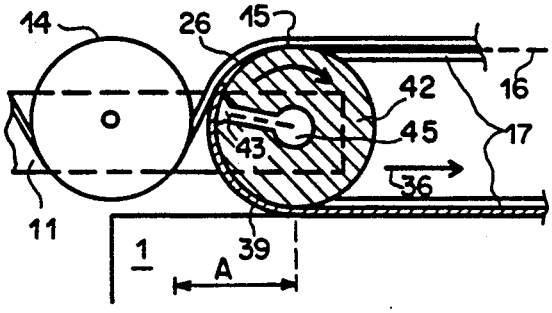
FIG. 4*b* shows the top sheet in the operation of introducing it into a transportation plane.

When the carriage 11 continues to move over the suction distance A, the suction roller 42 continues to rotate in the clockwise direction and, as can be seen from FIG. 4*b*, unrolls the front end of the sheet 39 from the stack 1, with the sheet lying snugly around the suction roller 42 and against the belt 17, and guides the rolled-up front end of the sheet 39 into a position between the belt 17 and the endless belt 26.

After a rotary movement of the suction roller 42 in the clockwise direction through an angle of rotation of at least 135°, that is to say as soon as the front end of the sheet 39 is engaged by the belts 17 and 26, the suction line 45 is vented again and the sheet 39 is released by the suction cups 43. The venting operation may be triggered off by a timing member in the control arrangement 34 (see FIG. 3), or, advantageously, independently of time, by means for detecting the position of the carriage 11, for example by the sensing device 37 or 38 (FIG. 1), after the carriage 11 has covered the distance A which is predetermined by that angle of rotary movement of the suction roller 42.

As the carriage 11 continues to move in the direction 36, the top sheet 39 which has been picked up is unrolled around the guide roller 15 from the stack 1 into the transportation plane 16 without the sheet 39 slipping on the stack 1. The sheet 39 moves ahead of the carriage 11 at double the speed of the carriage in the direction 36 until it is issued from the transportation system 29 (FIG. 1) through the second gate 31 (FIG. 1). The sensor signal from the second sensor 33 (FIG. 1) terminates the issue cycle.

The top sheet 39 can also be issued through the first gate 30 (FIG. 1) in the movement of the carriage 11 from the second limit position 10 (FIG. 1), that is to say in the opposite direction to the direction 36. The suction cups 43 of the suction roller 42 between the first guide rollers 13 (see FIG. 1) are aligned flat with the rear end of the sheet 39 as soon as the guide roller 13 has rolled over the rear or trailing edge of the sheet 39 and triggered off the sensing signal of the second sensing device 38 (FIG. 1). The rear end of the sheet 39 is fitted snugly around the guide rollers 13, rolled from the stack 1 in the counter-clockwise direction and introduced between the belts 17 and 26. The sensor signal from the first sensor 32 (FIG. 1) terminates that issue cycle.

The above-described apparatus has the advantage that the sheet 3 is guided by frictional contact between the belts 17 and 26 in the transportation system 29 in the receiving and issue operations and any sliding movement which could result in damage to the sheets 3 or jamming of the apparatus is prevented. The advantage of the rolling movement of the fixedly guided sheet 3 on the stack 1 lies in the fault-free processing of the sheets 3 of greatly different natures, as are observed for example as between new and well-used bank notes.

In regard to further configurations of the transportation system 29 and the control arrangement 34, attention is expressly directed to U.S. patent application No.

Figure 5:
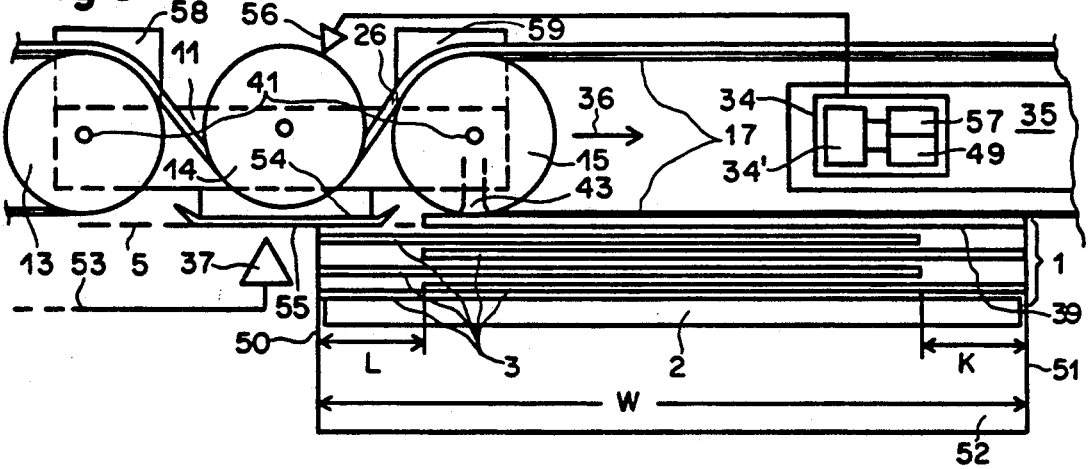
FIG. 5 shows a stack with displacement distances.

In FIG. 5 the control arrangement 34 has a counter 49, the state of which corresponds to the number of sheets 3 disposed in superposed relationship in the stack 1 on the plate 2. At the beginning of each externally triggered receiving cycle the control arrangement 34 reads off the state of the counter 49 and in a computing device 34' ascertains whether the number of sheets 3, 39 on the stack is an odd number or an even number.

As viewed in the direction 36, the stack has a front boundary 50 and a rear boundary 51. The boundaries 50 and 51 may be walls of a transportable cassette 52 which serves for replacement of the stack 1, in which respect the width W between the boundaries 50, 51 of the cassette 52 is advantageously greater than the length of the sheets 3, 39 as measured in the direction 36 so that the stack 1 can advantageously be stacked in an arrangement which is predetermined for fast and reliable issue of sheets 3, 39. In the drawing in FIG. 5, the uppermost sheets 3, 39 are illustrated in a separated condition, for reasons of clarity of the drawing, but in actual fact the displaced sheets 3, 39 lie fully one upon the other over their common section.

The sensing device 37 is arranged for example beneath the rail 8 (FIG. 1) and is connected to the control arrangement 34 by means of a signal line 53. The signal line 53 is not shown entirely as far as the control arrangement 34.

By way of example, the odd-number sheets 3, as counted from the plate 2, are arranged with their front edges flush with respect to the front boundary 50 while the even-number sheets terminate with their rear edge directly at the rear boundary 51. Successive positions are displaced relative to each other with the even-number sheets 3, 39 being spaced from the front boundary 50 by a predetermined first displacement distance L and the odd-number sheets being spaced from the rear boundary 51 by a predetermined second displacement distance K. If all sheets 3, 39 are of the same length, the two distances L and K are equal.

The position of the sheet 39 which is deposited on the stack 1 only depends on the location of the carriage 11 on the rail 8, which the carriage 11 occupied at the moment of engagement of the sheet 3 which now serves as the top sheet 39, by the belts 17 and 26, in the entry plane 27 (FIG. 1) or 28 (FIG. 1) respectively. After the receiving command for initiating the receiving cycle, the control arrangement 34 now waits for a sheet 3 to reach one of the two gates 30 and 31 (FIG. 1).

In a second step in the receiving cycle the control arrangement 34, on the basis of the state of the counter 49 and the entry plane 27 or 28 respectively used by the sheet 3, calculates the location of the carriage 11 which is prescribed for the correct position of the future top sheet 39, and controls the drive 35 to move the carriage 11 to that location before the sheet 3 is engaged by the belts 17 and 26. If the drive 35 has the stepping motor 35', the control arrangement 34 can ascertain the instantaneous position of the carriage 11 on the rail 8 from the number of steps. After the new top sheet 39 has been entirely rolled down in its predetermined position on the stack 1, the control arrangement 34 increases the state of the counter 49 by 1 and concludes the receiving cycle.

At the beginning of the issue cycle the direction of travel of the carriage 11 is ascertained during issue of the top sheet 39, being predetermined by the state of the counter 49 in the control arrangement 34, the direction of travel of the carriage 11 depending on the association which was used in the receiving cycle and which establishes which sheets 3, 39 are deposited with the displacement distance L.

In FIG. 5, for example, the top sheet 39 is the sixth, that is to say an even-number sheet 3 in the stack 1. If necessary, the carriage 11 first moves back in an idle motion to the first limit position 9 (FIG. 1). From there it begins its movement in the direction 36, moves over the displacement distance L and, as it passes over the front or leading edge of the top sheet 39, with the sensing device 37 triggers off the signal required to open the control valve 47 (FIG. 3).

The carriage 11 advantageously has a sliding shoe 54 between the two outer guide rollers 13 and 15; the sliding surface 55 of the sliding shoe 54, which is bent up at both ends, is disposed in the plane 5. The sliding surface 55 slides over the stack 1 in the plane 5 and prevents contact from occurring between the endless belt 26 and the stack 1 as long as the carriage 11 is over the stack 1. The sliding surface 55 extends in the plane 5 symmetrically with respect to the axis of the central guide roller 14. The length of the sliding surface 55 corresponds for example to the diameter of the central guide roller 14. The two gaps between the ends of the sliding shoe 54 and the lines of contact of the outer guide rollers 13 and 15 with the plane 5 determine a minimum necessary length of the displacement distance L.

When the top sheet 39 is lifted off with the suction cups 43, the sliding shoe 54 is on the displacement distance L of the sheet 3 which is directly beneath the top sheet 39, and prevents a second sheet 3 from being unintentionally picked up at the same time. That phenomenon may occur when dealing with partly damaged sheets 3 or when the top sheet 39 is lifted off excessively quickly from the exactly aligned stack 1, even when dealing with intact sheets 3.

Figure 2:
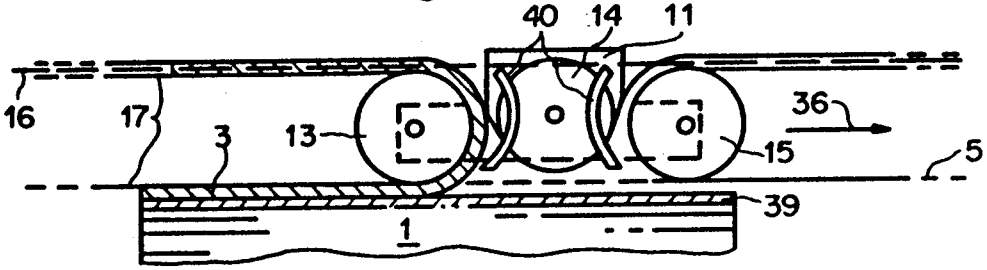
FIG. 2 shows a carriage with deflectors in the deposit operation.

The sliding shoe 54 may also be combined with the deflectors 40 (FIG. 2). Instead of the sliding shoe 54, it is also possible here to use rotatably mounted runners (not shown), the axes of which are disposed parallel to the roller axes 41 and the running surfaces of which roll in the stack plane 5.

The control arrangement 34 receives the signal from the sensor 32 (FIG. 1) or 33 (FIG. 1) as soon as the sheet 3 has left the apparatus. The state of the counter 49 decreases by 1 and the issue cycle is concluded.

Instead of the sensing devices 37, 38, the carriage 11 may have a rotary sender 56 which is connected by way of a line to the control arrangement 34 and which for example reads off any movement of one of the guide rollers 13 through 15 or of the carriage 11 and which at any time transmits to the control arrangement 34 a count value which corresponds to the precise position of the carriage 11 on the rail 8. The sender 56 may also be coupled to the belt 17 or the endless belt 26 or directly to the drive 35.

The control arrangement 34 effects a simple numerical comparison between the instantaneous count value of the rotary sender 56 or the present number of steps of the drive 35 and one of the reference positions of the carriage 11 and upon identity produces a signal which corresponds to the corresponding sensing signal from the sensing device 37 or 38 respectively. The advantage of that arrangement is that, upon a change in the predetermined set of sheets 3, there is no need for precise mechanical alignment of the positions of the sensing devices 37 and 38.

The apparatus is also suitable for dealing with sheets 3, 39 from a predetermined set of different sizes. The control arrangement 34 advantageously has a data storage means 57 in which it stores items of information which are necessary in the deposit of each sheet 3, for example the sheet length or an identification number corresponding to the length and the ordinal number of the sheets 3, 39 in the stack. In the issue operation the information relating to the issued top sheet 39 is erased so that the data storage means 57 always contains an up-to-date image of the stack 1.

When a new top sheet 39 is deposited on the stack 1, the length of the sheet 3 is passed to the control arrangement, together with the command for initiating the receiving cycle. The control arrangement 34 ascertains the new ordinal number and stores the information. The carriage 11 is then moved along the rail 8 into the calculated reference position. The new top sheet 39 is rolled off on the stack 1 in the above-described manner. The displacement distance L or K respectively is dependent on the sheet length.

At the beginning of the issue cycle the control arrangement calculates from the ordinal number and the sheet length which are stored in the data storage means 57 for the top sheet 39, the reference position for the carriage 11, which is prescribed for actuation of the control valve 47 (FIG. 3), so that the prescribed end of the top sheet 39 can be satisfactorily engaged by the suction cups 43.

The suction cups 43 are advantageously arranged on a plurality of generatrices on the periphery of the suction roller 42 (FIG. 3) so that at least the suction cups 43 of one of those generatrices are in a position which is suitable for picking up the top sheet 39 if the sheet lengths are different.

If the suction rollers 42 have only a single row of suction cups 43, the couplings 42' (FIG. 3) of the guide rollers 13 and 15 respectively are advantageously controllable by the control arrangement 34 by means of coupling signals and the suction rollers 42 of the guide rollers 13 and 15 respectively are provided with a return device 58 and 59 respectively with which, when the coupling 42' is disengaged, the suction cups 43 can be aligned in a radial position which is favourable to picking up the top sheet 39 from the stack 1, even when dealing with different distances L, K. The return devices 58, 59 are disposed on the carriage 11 and are controllable by the control arrangement 34 by way of lines (not shown here).

The control arrangement 34 triggers off operation of the return devices 58 and 59 when pick-up of the top sheet 39 is immediately imminent having regard to the instantaneous position of the travelling carriage 11. The return device 58 or 59 which is associated with the suction rollers 42 which are leading in the direction of travel of the carriage 11 aligns the suction roller 42 with the suction cups 43 in relation to the stack 1, immediately prior to the control valve 47 (FIG. 3) being switched over. As soon as the reduced pressure has reached the value required to pick up the top sheet 39, the control arrangement 34 operates the coupling 42' of the corresponding suction roller 42, by way of a line (not shown). The coupling 42' transmits the rotary movement of the guide rollers 13 or 15 to the suction rollers 42 until the top sheet 39 which has been sucked up by the suction cups 43 is introduced between the belts 17 and 26 and the suction cups 43 are vented.

The reduced pressure obtaining in the suction cups 43 advantageously directly actuates the coupling 42' so that there is then no need for the required circuits in the control arrangement 34 and the control arrangement is therefore of a simpler design configuration.

Figure 6:
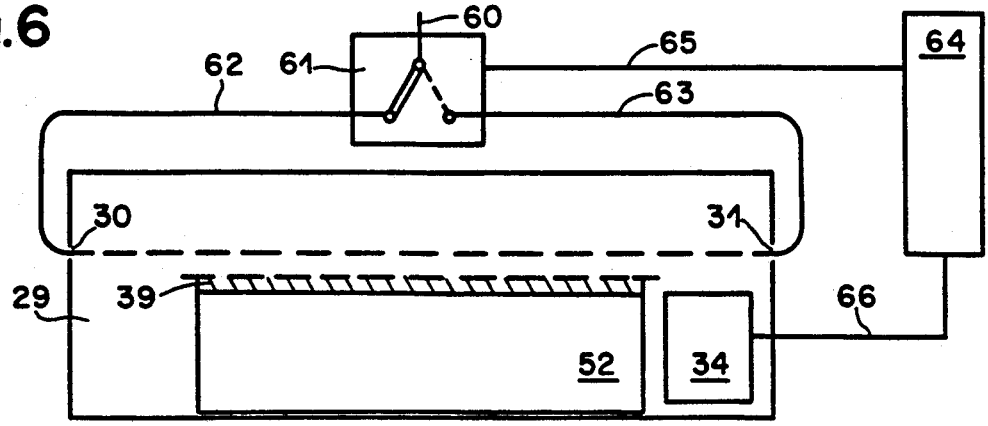
FIG. 6 shows a use of the apparatus.

A use of the apparatus as shown in FIG. 6 involves a conveyor means for sheets 3 (FIG. 1), comprising a feed section 60 and a switch device 61 with branch lines 62 and 63. In the switch device 61 the feed section 60 forks into the two branch lines 62 and 63 which extend to the two gates 30 and 31 of the transportation system 29. The conveyor means 60 through 63 transports the sheets 3 in both directions, for example from a checking device (not shown here) by way of the switch device 61 to the gate 30 or 31 or from the gate 30 or 31 by way of the switch device 61 into the feed section 60. An automatic service machine (not shown) comprises a control device 64 which is connected by way of a control line 65 to the switch device 61 and a drive means (not shown) of the conveyor means 60 through 63. The control device 64 supplies signals for controlling the switch device 61 and the conveyor means 60 through 63. An interchange line 66 provides for communication of data in both directions between the control arrangement 34 and the control device 64 in order to ensure satisfactory transportation of the sheets 3 in the transportation system 29 and in the conveyor means 60 through 63.

The control device 64 converts signals from the checking device in dependence on items of information concerning the top sheet 39 in the cassette 52 into a control command for the feed section 60 and for the switch device 61 and transmits same by way of the control line 65 to the conveyor means 60 through 63. By means of the data exchange line 66 the control arrangement 34 receives the command for triggering off the receiving cycle, together with the information concerning the branch line 62 or 63 which is prescribed for delivering the next sheet 3, and the dimension of that sheet 3.

If the automatic machine requires a sheet 3 from the cassette 52, the control device 64 gives the control arrangement 34 the command for initiating the issue cycle. The control arrangement 34 then informs the control device 64 about the top sheet 39 to be issued to that the control device 64 can give the conveyor means 60 through 63 and other parts of the automatic machine which are not mentioned herein commands which are required for transportation of the top sheet 39.

Having described a preferred embodiment of the invention with reference to the accompanying drawings, it is to be understood that the invention is not limited to the precise embodiment and that various changes and modification thereof may be effected by one skilled in the art without departing from the spirit or scope of the invention as defined in the appended claims.

What is claimed is:

1. Apparatus for receiving and issuing sheets, comprising:

a rail;

a carriage mounted for movement along a path on said rail;

first and second outer guide rollers mounted on said carriage;

a central guide roller mounted on said carriage between said first and second outer guide rollers;

a first belt extending between said first and central guide rollers, part-way around and below said central guide roller, and between said second and central guide rollers;

a second belt having first and second portions, said first portion of said second belt extending part-way around said first guide roller and defining with the first belt a first transportation path for sheets, and said second portion of said second belt extending part-way around said second guide roller and defining with the first belt a second transportation path for sheets;

support means for supporting a stack of sheets below said path of movement of said carriage; and drive means for causing the carriage to move along said path of movement;

wherein the improvement comprises:

first and second suction devices and control valves associated with said first and second outer guide rollers, respectively, each control valve being operable to cause the respective suction device to suck a top sheet of said stack towards the respective portion of said second belt; and control means operably connected to said drive means, control valves and detecting means and operable in an issuing cycle to recognize a position of said carriage along said rail which is suitable for one of said suction devices to suck the top sheet of the stack, to operate the respective control valve to cause that suction device to suck said top sheet, and to cause said drive means to move said carriage such that said top sheet is rolled from said stack in a slip-free manner around the respective outer guide roller and is carried along the respective transportation path.

2. Apparatus according to claim 1, wherein each suction device comprises a suction roller mounted for rotation with the respective outer guide roller, each suction roller having a plurality of suction cups which are formed along a common generatrix of said suction roller and which are connected together by a plurality of passageways.

3. Apparatus according to claim 2, wherein each suction roller has at least one further plurality of suction cups which are formed along at least one further generatrix of said suction roller, so that at least one of said pluralities of suction cups are favorably positioned for picking up the top sheet of said stack.

4. Apparatus according to claim 2, further comprising first and second clutch means for controllably coupling said first and second outer guide rollers respectively, to the respective suction roller, and first and second return means each operable when the respective clutch means is released, for rotating the respective suction roller so that the suction cups thereon are favorably positioned for picking up the top sheet of the stack.

5. Apparatus according to claim 4, wherein said clutch means are controlled by said control means.

6. Apparatus according to claim 4, wherein said clutch means are controlled by suction applied to the respective suction rollers.

7. Apparatus according to claim 1, wherein the control means is operable in a receiving cycle to cause the drive means to move the carriage such that a sheet in one of said transportation paths is rolled in a slip-free manner around the respective outer guide roller and onto the top of said stack, and wherein said control means includes counter means for storing the number of sheets in said stack, said number being incremented with each receiving cycle and being decremented with each issuing cycle, and wherein the control means is operable at the beginning of each cycle to cause the drive means to move the carriage to a position dependent on the value of the stored number.

8. Apparatus according to claim 7, wherein said control means causes the sheets to be stacked such that adjacent sheets in said stack are offset, and wherein said support means comprises a cassette of a size sufficient to accommodate the offset sheets of said stack.

9. Apparatus according to claim 8, further comprising a shoe which is mounted on said carriage between said outer guide rollers and beneath said central guide roller and which is adapted to hold down an exposed edge of that sheet of said stack beneath the top sheet while the top sheet is sucked by one of said suction devices.

10. Apparatus according to claim 1, wherein the control means includes data storage means for storing data relating to each of the sheets currently in the stack.

11. Apparatus according to claim 1, wherein said control means comprises a rotary encoder which generates a value indicative of the position of said carriage, and wherein the control means is operable to compare said value with at least one predetermined value to detect a predetermined position of said carriage.

12. Apparatus according to claim 1, wherein said drive means comprises a stepping motor and wherein said control means is operable to supply step pulses to said stepping motor, to ascertain the position of said carriage from the pulses supplied to said motor and to compare the ascertained position of said carriage with at least one predetermined position thereof.

* * * * *